US010016991B1

(12) United States Patent
Nishimura

(10) Patent No.: US 10,016,991 B1
(45) Date of Patent: Jul. 10, 2018

(54) CARRIAGE ASSEMBLY FOR A PRINTER HAVING INDEPENDENT RESERVOIRS

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/443,520

(22) Filed: Feb. 27, 2017

(51) Int. Cl.

| | |
|---|---|
| ***B41J 2/175*** | (2006.01) |
| ***B41J 2/18*** | (2006.01) |
| ***B41J 2/145*** | (2006.01) |
| ***B41J 25/00*** | (2006.01) |
| ***B41J 2/14*** | (2006.01) |

(52) U.S. Cl.
CPC ..... *B41J 25/001* (2013.01); *B41J 2/1433* (2013.01); *B41J 2002/14419* (2013.01)

(58) Field of Classification Search
CPC ... B41J 2/175; B41J 2/18; B41J 2/1433; B41J 25/001; B41J 2002/14419
USPC ..... 347/37
See application file for complete search history.

(56) References Cited

U.S. PATENT DOCUMENTS

2013/0135404 A1* 5/2013 Murray ..... B41J 2/175 347/92

* cited by examiner

*Primary Examiner* — Huan Tran
*Assistant Examiner* — Alexander D Shenderov
(74) *Attorney, Agent, or Firm* — Duft Bornsen & Fettig LLP

(57) ABSTRACT

A carriage assembly for a printer that reciprocates along scan directions. The carriage assembly includes at least one printhead having a row of jetting channels for ejecting a print fluid, and reservoirs mounted on the carriage assembly that each supply the print fluid to the printhead. At least one of reservoirs is mounted on the carriage assembly to be offset from the row of jetting channels.

20 Claims, 7 Drawing Sheets

CARRIAGE ASSEMBLY FOR A PRINTER HAVING INDEPENDENT RESERVOIRS

FIELD OF THE INVENTION

The following disclosure relates to the field of printing, and in particular, to carriage assemblies for printers.

BACKGROUND

Inkjet printing is a type of printing that propels drops of ink (also referred to as droplets) onto a medium, such as paper, a substrate for 3D printing, etc. The core of an inkjet printer includes one or more printheads (also referred to as inkjet heads) having multiple jetting channels arranged in a row to discharge drops of ink. A typical jetting channel includes a nozzle, a chamber, and a mechanism for ejecting the ink from the chamber and through the nozzle, which is typically a piezoelectric actuator connected to a diaphragm. To discharge a drop from a jetting channel, a drive circuit provides a drive waveform to the piezoelectric actuator of that jetting channel that includes a jetting pulse. In response to the jetting pulse, the piezoelectric actuator generates pressure oscillations inside of the chamber to push the drop out of the nozzle. The drive waveforms provided to individual piezoelectric actuators control how drops are ejected from each of the jetting channels.

Shuttle-type printers are a class of printers having a movable shuttle or carriage assembly that reciprocates back and forth across a medium. A printhead is mounted on the carriage assembly, and jetting from the printhead is synchronized with movement of the carriage assembly to print desired images. Movement of the carriage assembly is also synchronized with a medium transfer mechanism that advances the medium through the printer.

It remains an issue for manufacturers to find effective ways to supply ink or another print fluid to printheads in shuttle-type printers.

SUMMARY

Embodiments described herein include a carriage assembly for a printer that has one or more printheads, and independent reservoirs that supply a print fluid to the printhead. The reservoirs are mounted on the carriage assembly, and at least one of the reservoirs is offset from the printhead. When the carriage assembly accelerates and decelerates in the scan directions, force is created that causes the print fluid to flow between the reservoirs through the printhead. The motion of the carriage assembly creates a differential pressure between the reservoirs due to the way the reservoirs are mounted in an offset position, and allows ink to flow through the printhead. Thus, the printhead remains primed, and print fluid is able to be circulated through the printhead without the use of a circulation pump.

One embodiment includes an apparatus comprising a carriage assembly of a printer that reciprocates along scan directions. The carriage assembly includes at least one printhead having a row of jetting channels for ejecting a print fluid, and reservoirs mounted on the carriage assembly that each supply the print fluid to the printhead. At least one of reservoirs is mounted on the carriage assembly to be offset from the row of jetting channels.

In another embodiment, the at least one printhead includes manifolds disposed in the printhead along the opposite sides of the row of jetting channels. A first one of the manifolds is fluidly connected to a first one of the reservoirs, and fluidly connected to each of the jetting channels. A second one of the manifolds is fluidly connected to a second one of the reservoirs, and fluidly connected to each of the jetting channels.

In another embodiment, the first one of the manifolds is disposed in the printhead along a first side of the row of jetting channels, and parallels the row of jetting channels. The second one of the manifolds is disposed in the printhead along a second side of the row of jetting channels, and parallels the row of jetting channels.

In another embodiment, the row of jetting channels defines an axis perpendicular to the scan directions of the carriage assembly. A first one of the reservoirs is offset from the axis by a first distance in a first scan direction, and a second one of the reservoirs is offset from the axis by a second distance in a second scan direction that is opposite the first scan direction.

In another embodiment, the first distance and the second distance are equal.

In another embodiment, the row of jetting channels defines an axis perpendicular to the scan directions of the carriage assembly. A first one of the reservoirs is offset from the axis by a first distance in a scan direction, a second one of the reservoirs is offset from the axis by a second distance in the scan direction, and the first distance is different than the second distance.

In another embodiment, the at least one printhead comprises a flow-through printhead.

Another embodiment comprises a carriage assembly of a printer that is configured to reciprocate along scan directions. The carriage assembly includes a printhead having a row of jetting channels for ejecting a print fluid, a first manifold disposed along a first side of the row of jetting channels and fluidly connected to each of the jetting channels, and a second manifold disposed along a second side of the row of jetting channels and fluidly connected to each of the jetting channels. The carriage assembly also includes a first reservoir fluidly connected to the first manifold of the printhead, and a second reservoir fluidly connected to the second manifold of the printhead. At least one of the first reservoir and the second reservoir is offset from the row of jetting channels.

In another embodiment, the first reservoir is mounted on the carriage assembly on the first side of the row of jetting channels, and the second reservoir is mounted on the carriage assembly on the second side of the row of jetting channels.

In another embodiment, the first reservoir and the second reservoir are mounted on the carriage assembly on the first side of the row of jetting channels.

In another embodiment, the row of jetting channels defines an axis perpendicular to the scan directions of the carriage assembly. The first reservoir is offset from the axis by a first distance in a first scan direction, and the second reservoir is offset from the axis by a second distance in a second scan direction that is opposite the first scan direction.

In another embodiment, the first distance and the second distance are equal.

In another embodiment, the row of jetting channels defines an axis perpendicular to the scan directions of the carriage assembly, the first reservoir is offset from the axis by a first distance in a scan direction, the second reservoir is offset from the axis by a second distance in the scan direction, and the first distance is different than the second distance.

In another embodiment, the printhead comprises a flow-through printhead.

Another embodiment includes a printer comprising a carriage assembly comprising a conveyance structure that reciprocates along scan directions within the printer, and at least one printhead mounted on the conveyance structure, where the at least one printhead has a row of jetting channels for ejecting a print fluid. The carriage assembly further includes a first manifold disposed along a first side of the row of jetting channels and fluidly connected to each of the jetting channels, and a second manifold disposed along a second side of the row of jetting channels and fluidly connected to each of the jetting channels. The carriage assembly further includes a first reservoir for storing the print fluid, and a second reservoir for storing the print fluid. At least one of the first reservoir and the second reservoir is mounted on the conveyance structure offset from the row of jetting channels.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
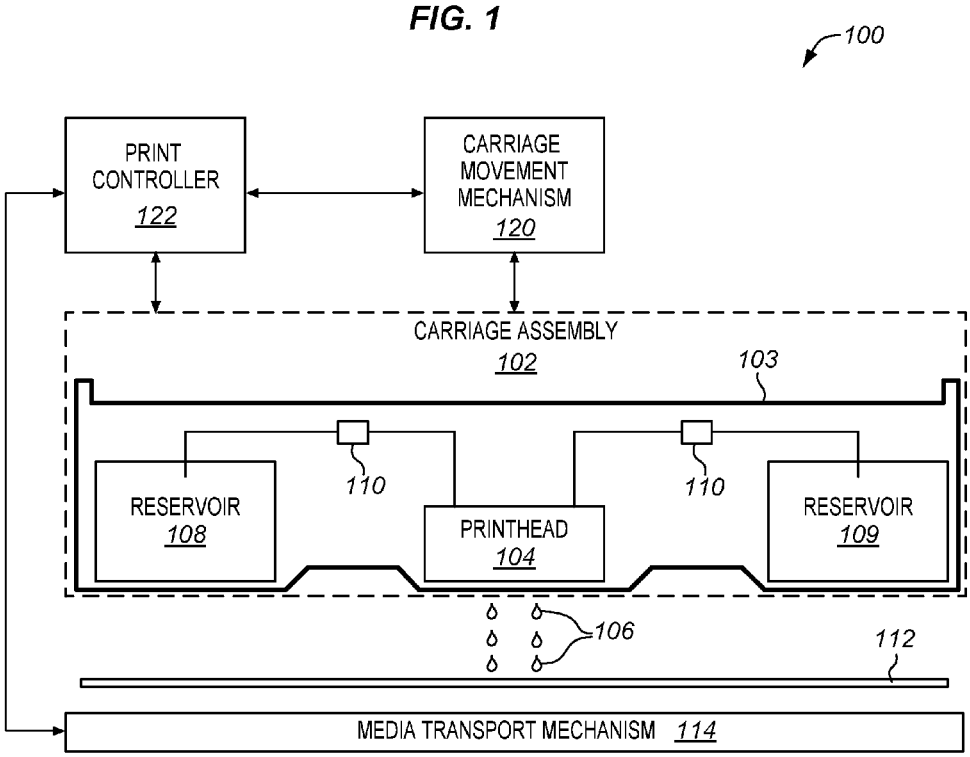
FIG. 1 is a schematic diagram of an image forming apparatus in an exemplary embodiment.

FIG. 1 is a schematic diagram of an image forming apparatus 100 in an exemplary embodiment. Image forming apparatus 100, such as a printer, is a shuttle-type apparatus that includes a carriage assembly 102. Carriage assembly 102 includes a conveyance structure 103 that reciprocates back and forth along a scan line or scan directions during operation. One or more inkjet heads or printheads 104 are mounted on conveyance structure 103. Printhead 104 is configured to eject drops 106 of a print fluid, such as ink (e.g., water, solvent, oil, or UV-curable), through a plurality of orifices or nozzles (not visible in FIG. 1). Independent reservoirs 108-109 are also mounted on conveyance structure 103. Each reservoir 108-109 is configured to store the same type of print fluid (e.g., same color of ink), and is fluidly connected to printhead 104. Negative pressure regulators 110 may be installed between reservoirs 108-109 and printhead 104 to regulate negative pressures of print fluid flowing from a reservoir 108-109 to printhead 104. The height of reservoirs 108-109 may also be adjusted to create negative pressure, which may eliminate the use of pressure regulators 110.

Conveyance structure 103 may comprise any desired structure for mounting printhead 104 and reservoirs 108-109. The shape of conveyance structure 103 may vary as desired. In one embodiment, conveyance structure 103 may have the shape or profile of an inkjet cartridge or pen that are used in a printer.

The drops 106 ejected from the nozzles of printhead 104 are directed toward a medium 112. Medium 112 comprises any type of material upon which ink or another print fluid is applied by a printhead, such as paper, card stock, transparent sheets, a substrate for 3D printing, cloth, etc. Typically, nozzles of printhead 104 are arranged in one or more rows so that ejection of print fluid from the nozzles causes formation of characters, symbols, images, layers of an object, etc., on medium 112 as printhead 104 and medium 112 are moved relative to one another. Media transport mechanism 114 moves medium 112 relative to printhead 104.

In this embodiment, image forming apparatus 100 is a shuttle-type apparatus, where carriage assembly 102 reciprocates back and forth across a surface of medium 112 (e.g., left and right in FIG. 1). To provide the movement of carriage assembly 102, image forming apparatus 100 includes a carriage movement mechanism 120 that moves carriage assembly 102 relative to medium 112 to perform print operations. For example, carriage movement mechanism 120 may include one or more elongated rods, and carriage assembly 102 may be slidably mounted to the elongated rods to move bi-directionally over the medium 112. Carriage movement mechanism 120 may also include an actuator that slides carriage assembly 102 along the elongated rods.

Image forming apparatus 100 also includes a print controller 122 that communicates with carriage assembly 102, media transport mechanism 114, and carriage movement mechanism 120. Print controller 122 may connect to a data source to receive printable data. Print controller 122 then controls carriage assembly 102, media transport mechanism 114, and carriage movement mechanism 120 to print the printable data on medium 112 via printhead 104.

Figure 2:
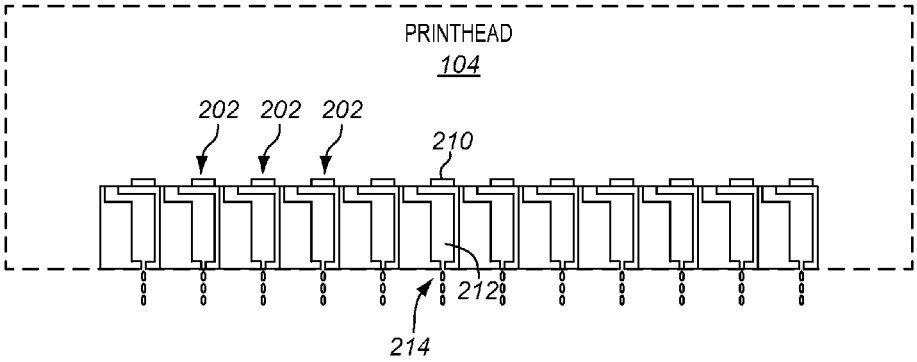
FIG. 2 is a cross-sectional view of a set of jetting channels within a printhead.

FIG. 2 is a cross-sectional view of a set of jetting channels 202 within printhead 104. Printhead 104 includes multiple jetting channels 202 that are arranged in a line or row, a portion of which are illustrated in FIG. 2. Each jetting channel 202 includes a piezoelectric actuator 210, a chamber 212, and a nozzle 214. Piezoelectric actuators 210 are configured to receive drive waveforms, and to actuate or "fire" in response to a jetting pulse on the drive waveform. Firing of a piezoelectric actuator 210 in a jetting channel 202 creates pressure waves in chamber 212 that cause jetting of droplets from its corresponding nozzle 214.

Figure 3:
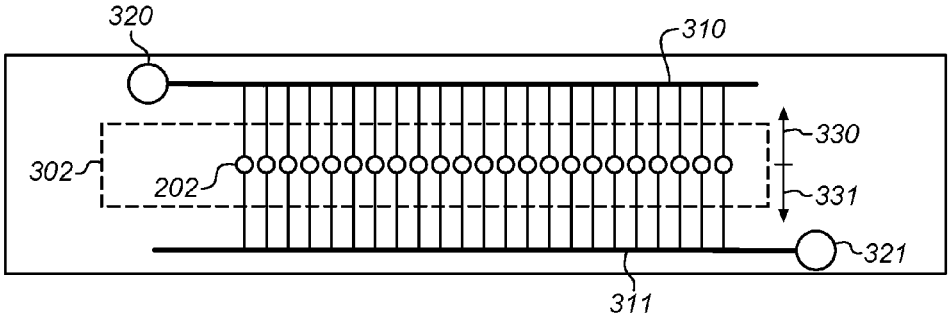
FIG. 3 is a schematic view of a printhead in an exemplary embodiment.

FIG. 3 is a schematic view of printhead 104 in an exemplary embodiment. In FIG. 3, jetting channels 202 are arranged in a straight line or row 302 within printhead 104. To supply ink or another print fluid to jetting channels 202, printhead 104 includes manifolds 310-311. A manifold comprises a groove, duct, conduit, etc., disposed substantially parallel to the row 302 of jetting channels 202 within printhead 104, and fluidly connected to each jetting channel 202 to supply ink or other print fluid. The row 302 of jetting channels 202 has opposing sides 330-331. Manifold 310 is disposed along one side 330 of the row 302 of jetting channels 202, and manifold 311 is disposed along the opposite side 331 of the row 302 of jetting channels 202. Manifolds 310-311 are fluidly connected to one another, such as through jetting channels 202. For example, a print fluid may flow between manifold 310 and manifold 311 through jetting channels 202, assuming that printhead 104 is a flow-through printhead. Thus, the same type of fluid (e.g., same color of ink) is supplied to both manifolds 310-311.

Printhead 104 also includes fluid ports 320-321. Fluid port 320 provides a pathway to manifold 310 of printhead 104. Fluid port 321 provides a pathway to manifold 311 of printhead 104. Fluid ports 320-321 may be connected (e.g., through a supply hose) to reservoirs 108-109, respectively.

Figure 4:
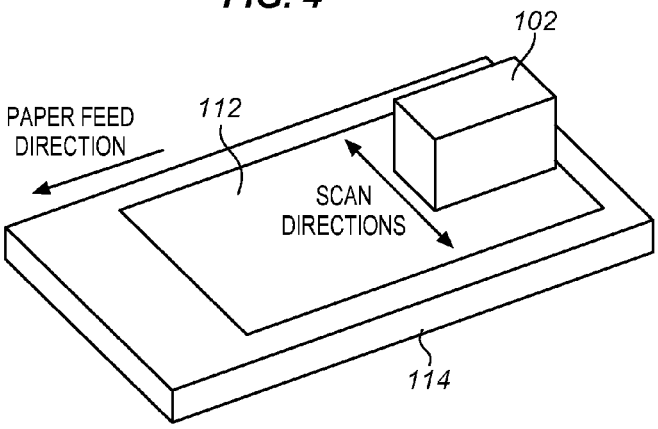
FIG. 4 is a perspective view of a carriage assembly moving in relation to a medium in an exemplary embodiment.

In the embodiments described herein, reservoirs 108-109 are mounted to carriage assembly 102 along with printhead 104, and at least one of reservoirs 108-109 are offset from the row 302 of jetting channels 202. Thus, as carriage assembly 102 reciprocates along the scan directions, acceleration and deceleration of carriage assembly 102 causes a differential pressure between reservoirs 108-109. FIG. 4 is a perspective view of carriage assembly 102 moving in relation to medium 112 in an exemplary embodiment. Medium 112 is fed along the paper feed direction by media transport mechanism 114. Carriage assembly 102 is driven to move in reciprocation along the scan directions, which are substantially perpendicular to the paper feed direction (or sub-scan direction). The drive mechanism for carriage assembly 102 is beyond the scope of this specification, but may include a motor, a drive belt, guide rails, etc.

Figure 5:
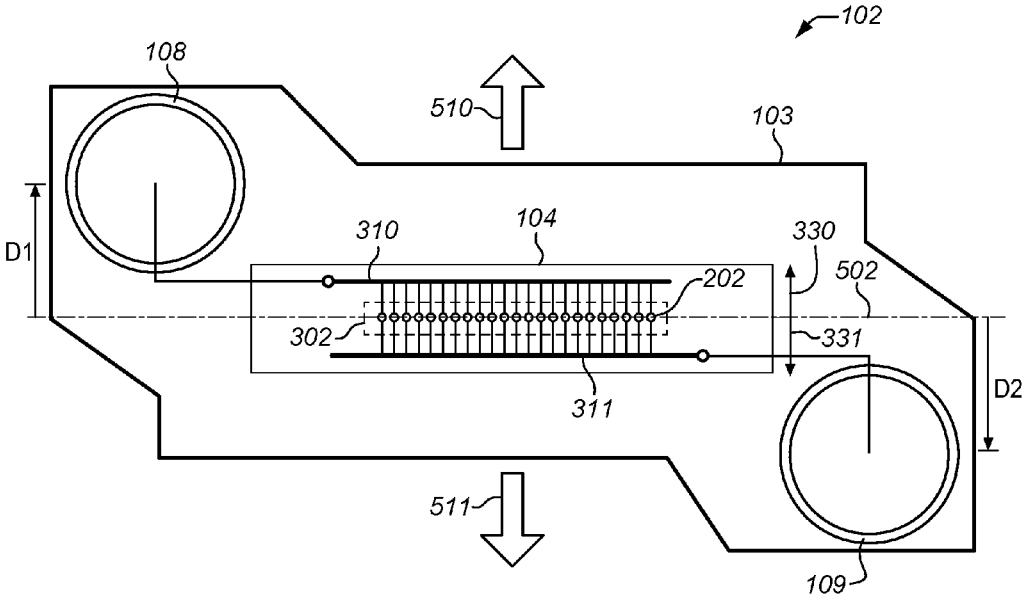
FIG. 5 is a top schematic view of a carriage assembly in an exemplary embodiment.

FIG. 5 is a top schematic view of carriage assembly 102 in an exemplary embodiment. Reservoir 108 is fluidly connected to manifold 310 of printhead 104 to supply a print fluid, and reservoir 109 is fluidly connected to manifold 311 of printhead 104 to supply the print fluid. Manifold 310 supplies the print fluid to the row 302 of jetting channels 202 from one side of the row 302, and manifold 311 supplies the print fluid to the row 302 of jetting channels 202 (see FIG. 3) from an opposite side of the row 302.

In this embodiment, reservoirs 108-109 are mounted on opposite sides of carriage assembly 102, and are offset from the row 302 of jetting channels 202. The arrangement of jetting channels 202 defines an axis 502 for the row 302. Axis 502 represents a line of direction or orientation of jetting channels 202 in the row 302. Reservoir 108 is mounted on side 330 of the row 302 of jetting channels 202, and is offset from axis 502 on side 330. Reservoir 109 is mounted on side 331 of the row 302 of jetting channels 202, and is offset from axis 502 on side 331. To be "offset" means that a center portion of a reservoir is not in-line with the row 302 of jetting channels along axis 502 (or more particularly, not in-line with its corresponding manifold), but is separated from axis 502 or its corresponding manifold by an amount or distance. The sides of the row 302 of jetting channels 202/axis 502 are along the scan directions of carriage assembly 102. For example, reservoir 108 is offset from axis 502 by distance D1 along a first scan direction 510 of carriage assembly 102. Reservoir 109 is offset from axis 502 by distance D2 along a second (opposing) scan direction 511 of carriage assembly 102. The distances D1 and D2 may be equal in a preferred embodiment, but may be different in other embodiments.

Figure 6:
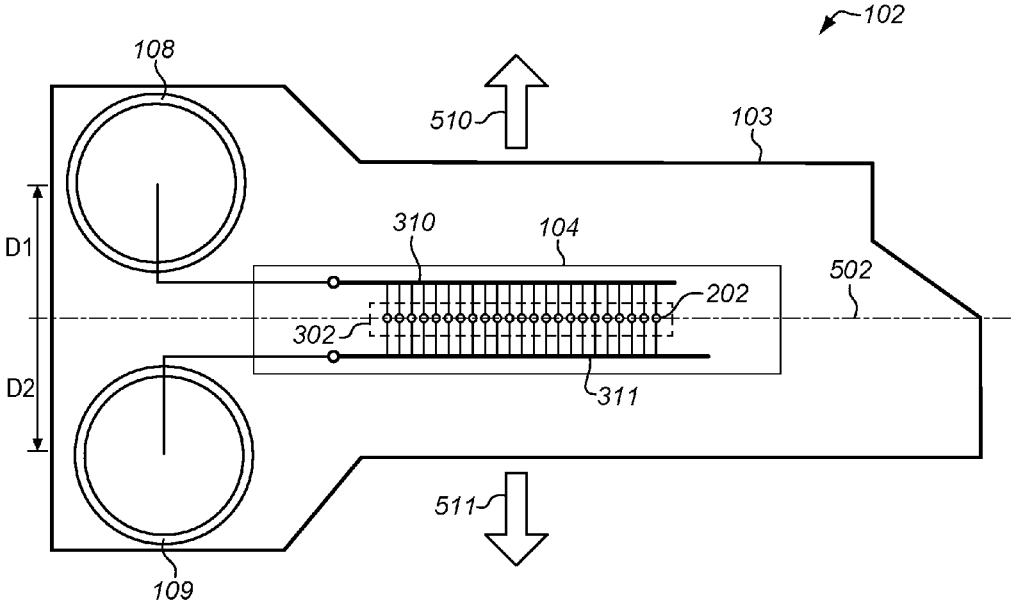
FIG. 6 is another top schematic view of a carriage assembly in an exemplary embodiment.

FIG. 6 is another top schematic view of carriage assembly 102 in an exemplary embodiment. In this arrangement, reservoirs 108-109 are mounted on the same end of carriage assembly 102, and are offset from the row 302 of jetting channels 202. As in the above embodiment, reservoir 108 is offset from axis 502 by distance D1 along scan direction 510 of carriage assembly 102. Reservoir 109 is offset from axis 502 by distance D2 along scan direction 511 of carriage assembly 102.

Figure 7:
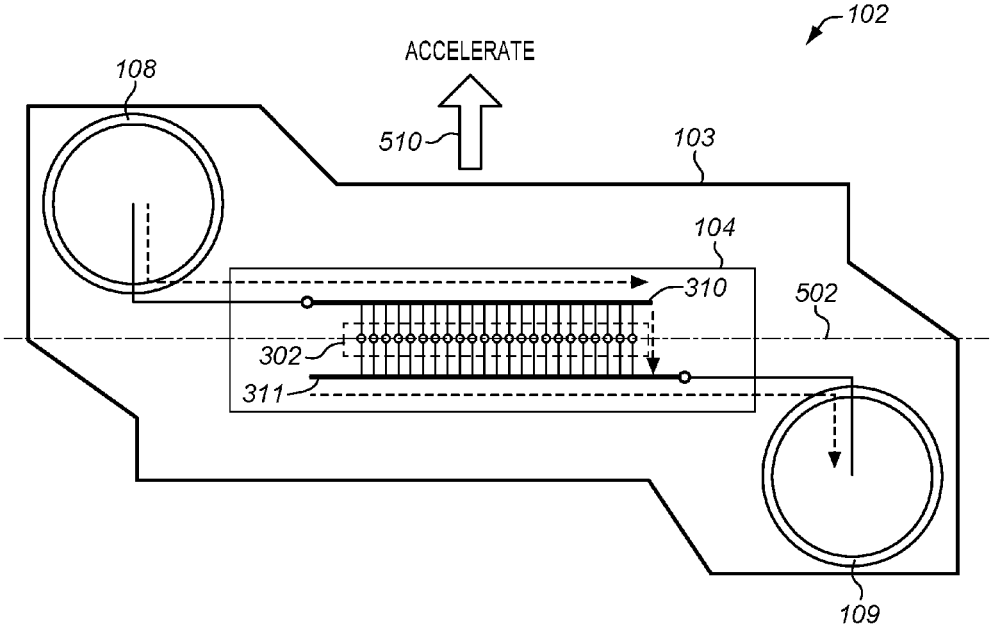
FIG. 7 illustrates a flow of print fluid due to acceleration of a carriage assembly along a scan direction in an exemplary embodiment.

When reservoirs 108-109 are offset as in FIGS. 5-6, movement of carriage assembly 102 along the scan directions 510-511 creates a flow of print fluid from reservoirs 108-109 to manifolds 310-311 of printhead 104. This in turn provides the print fluid to the row 302 of jetting channels 202 so that jetting channels 202 have a supply of the print fluid for jetting. FIGS. 7-10 illustrate a flow of print fluid due to movement of carriage assembly 102 along the scan directions. FIG. 7 illustrates a flow of print fluid due to acceleration of carriage assembly 102 along scan direction 510 in an exemplary embodiment. When carriage assembly 102 accelerates along scan direction 510, the acceleration creates a G-force that causes the print fluid to flow in the direction indicated by the arrows. More particularly, the G-force causes the print fluid to flow from reservoir 108 to manifold 310, and from manifold 311 to reservoir 109. If jetting channels 202 in the row 302 are flow-through, then the print fluid will also flow from manifold 310 through the jetting channels 202 to manifold 311.

Figure 8:
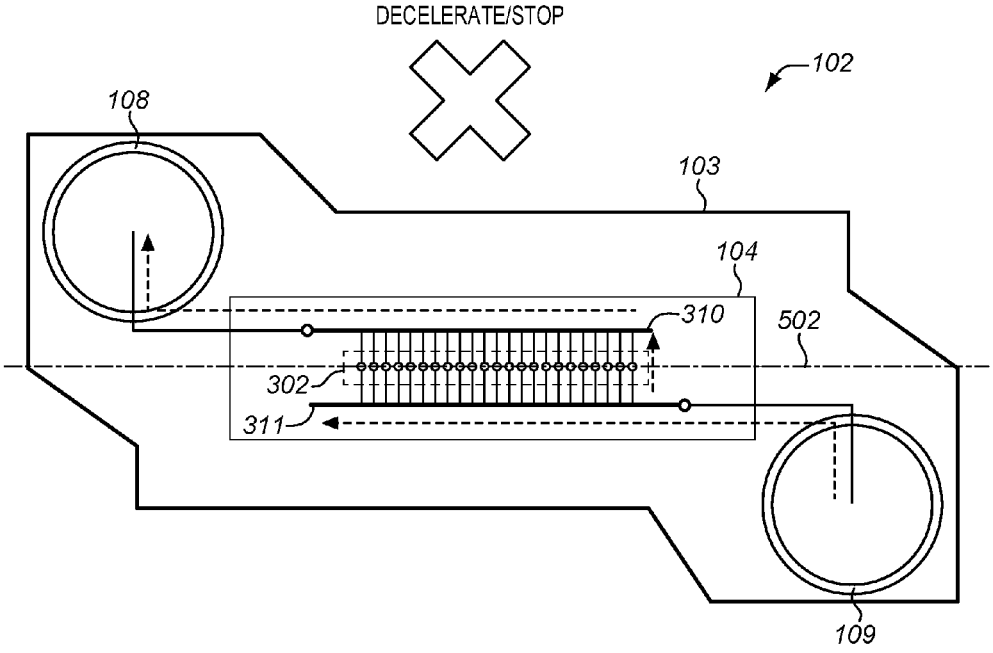
FIG. 8 illustrates a flow of print fluid due to deceleration or stopping of a carriage assembly that was moving along a scan direction in an exemplary embodiment.

FIG. 8 illustrates a flow of print fluid due to deceleration or stopping of carriage assembly 102 that was moving along scan direction 510 in an exemplary embodiment. When carriage assembly 102 is initially moving along scan direction 510 and then decelerates or stops, this creates a G-force that causes the print fluid to flow in the direction indicated by the arrows. More particularly, the G-force causes the print fluid to flow from reservoir 109 to manifold 311, and from manifold 310 to reservoir 108. If jetting channels 202 in the row 302 are flow-through, then the print fluid will also flow from manifold 311 through the jetting channels 202 to manifold 310.

Figure 9:
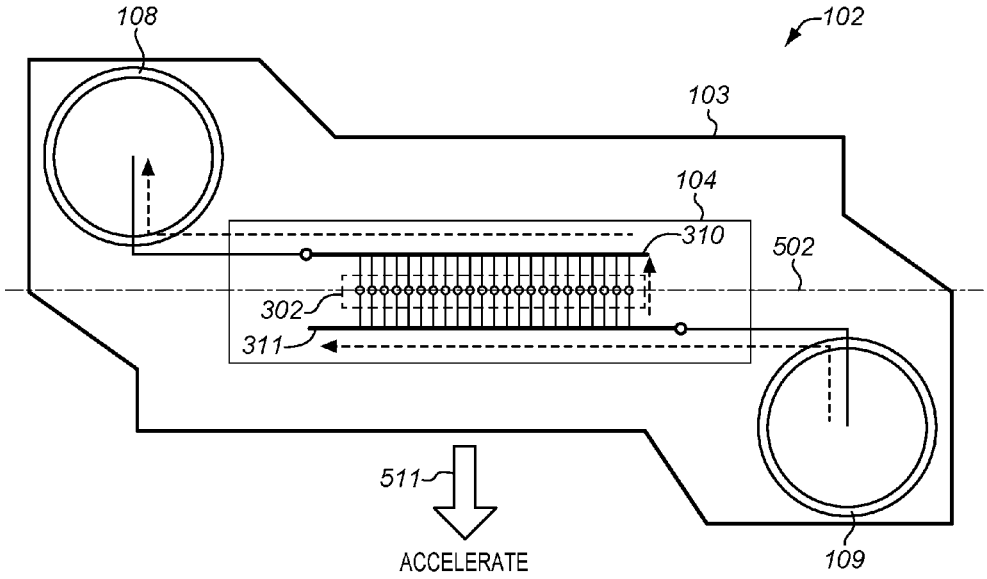
FIG. 9 illustrates a flow of print fluid due to acceleration of a carriage assembly along a scan direction in an exemplary embodiment.

FIG. 9 illustrates a flow of print fluid due to acceleration of carriage assembly 102 along scan direction 511 in an exemplary embodiment. When carriage assembly 102 accelerates along scan direction 511, the acceleration creates a G-force that causes the print fluid to flow in the direction indicated by the arrows. More particularly, the G-force causes the print fluid to flow from reservoir 109 to manifold 311, and from manifold 310 to reservoir 108. If jetting channels 202 in the row 302 are flow-through, then the print fluid will also flow from manifold 311 through the jetting channels 202 to manifold 310.

Figure 10:
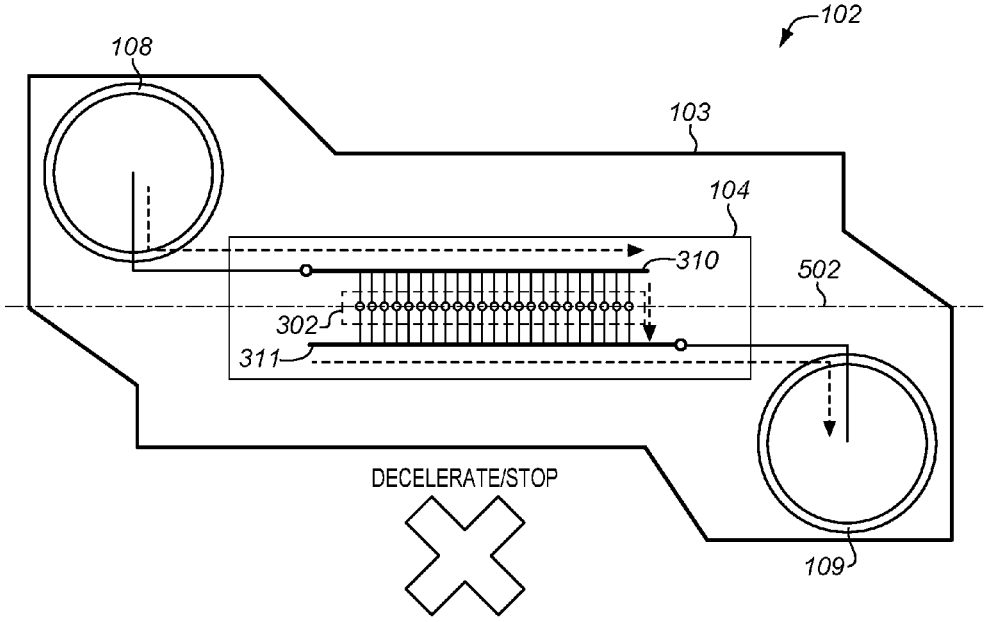
FIG. 10 illustrates a flow of print fluid due to deceleration or stopping of a carriage assembly that was moving along a scan direction in an exemplary embodiment.

FIG. 10 illustrates a flow of print fluid due to deceleration or stopping of carriage assembly 102 that was moving along scan direction 511 in an exemplary embodiment. When carriage assembly 102 is initially moving along scan direction 511 and then decelerates or stops, this creates a G-force that causes the print fluid to flow in the direction indicated by the arrows. More particularly, the G-force causes the print fluid to flow from reservoir 108 to manifold 310, and from manifold 311 to reservoir 109. If jetting channels 202 in the row 302 are flow-through, then the print fluid will also flow from manifold 310 through the jetting channels 202 to manifold 311.

Figure 11:
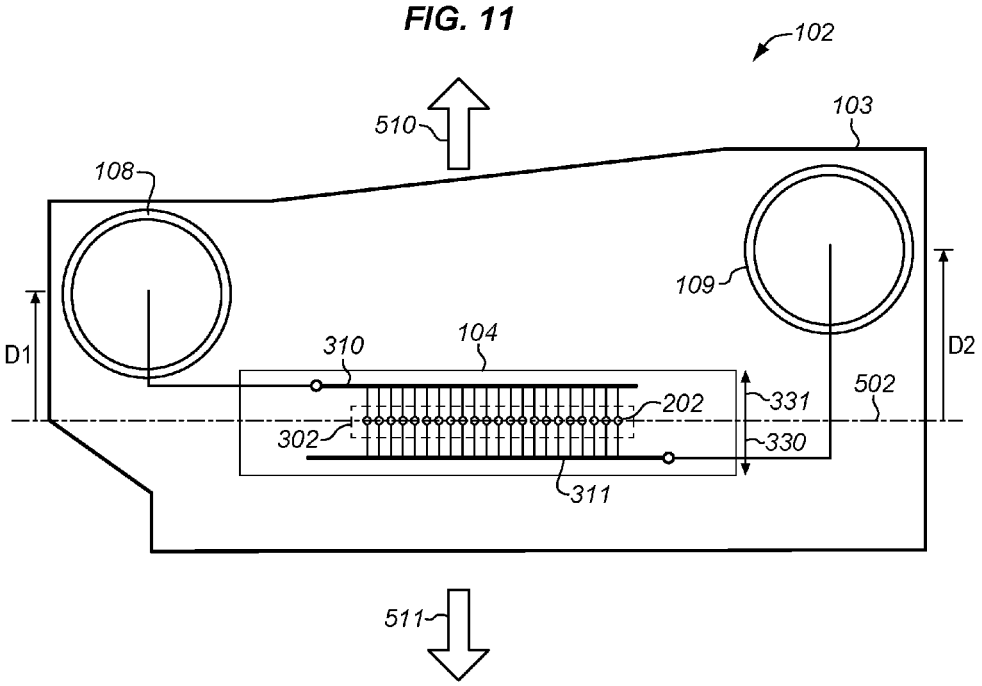
FIG. 11 is another top schematic view of a carriage assembly in an exemplary embodiment.

FIG. 11 is another top schematic view of carriage assembly 102 in an exemplary embodiment. In this embodiment, reservoirs 108-109 are mounted on the same side of carriage assembly 102, and are offset from the row 302 of jetting channels 202 by different amounts. Reservoir 108 is offset from axis 502 by distance D1 along scan direction 510 of carriage assembly 102, and reservoir 109 is offset from axis 502 by distance D2 along scan direction 510 of carriage assembly 102. The distances D1 and D2 are different so that the print fluid has to travel a different distance between reservoir 108 and manifold 310 (along the scan directions 510-511) than the print fluid has to travel between reservoir 109 and manifold 311. Movement of carriage assembly 102 along the scan directions 510-511 therefore creates a differential pressure between reservoirs 108-109.

Figure 12:
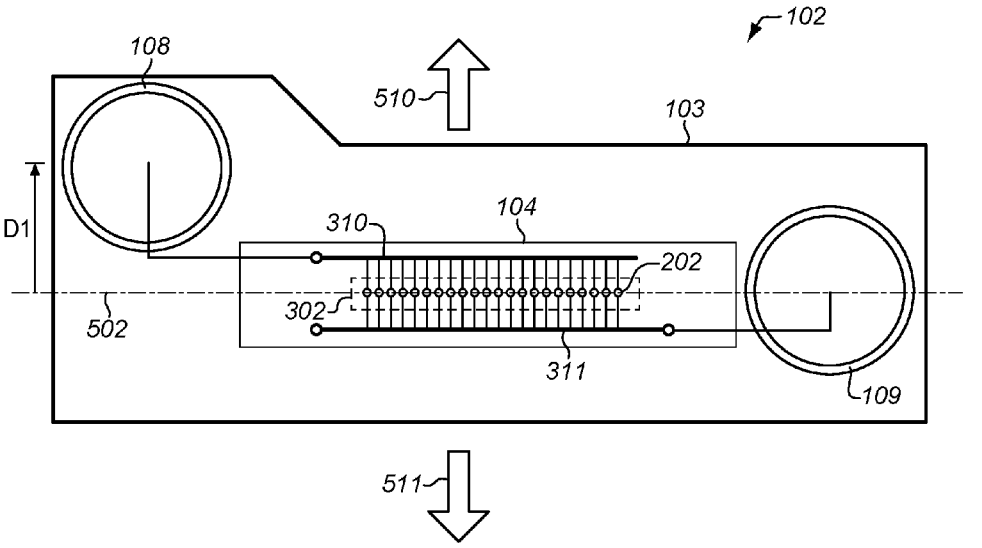
FIG. 12 is another top schematic view of a carriage assembly in an exemplary embodiment.

FIG. 12 is another top schematic view of carriage assembly 102 in an exemplary embodiment. In this embodiment, one reservoir 108 is offset from the row 302 of jetting channels 202, and the other reservoir 109 is mounted in-line with the row 302 of jetting channels 202. Reservoir 108 is offset from axis 502 by distance D1 along scan direction 510 of carriage assembly 102, and reservoir 109 is not offset but is in-line with axis 502. Again, the print fluid has to travel a different distance between reservoir 108 and manifold 310 (along the scan directions 510-511) than the print fluid has to travel between reservoir 109 and manifold 311. Movement of carriage assembly 102 along the scan directions 510-511 therefore creates a differential pressure between reservoirs 108-109. Carriage assembly 102 may be used with a flow-through printhead or a non-flow-through printhead. A flow-through printhead, for example, allows for ink to circulate through the jetting channels even when the jetting channels are not jetting.

Figure 13:
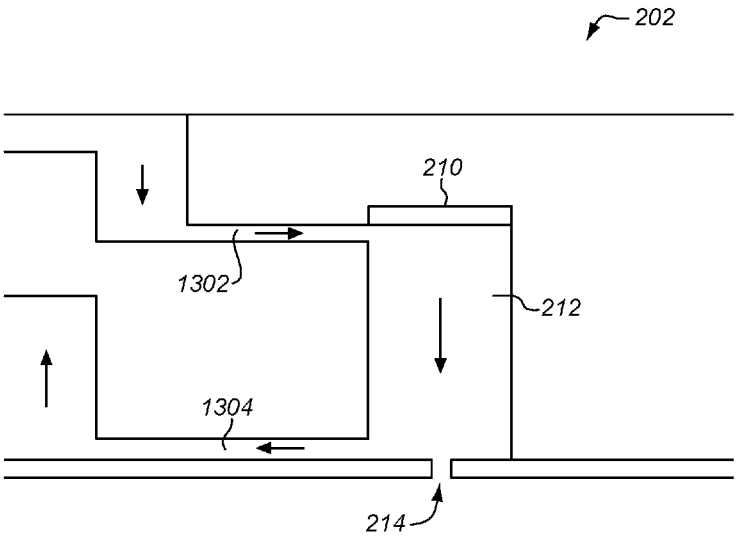
FIG. 13 illustrates a jetting channel in a printhead in an exemplary embodiment.

FIG. 13 illustrates a jetting channel 202 in printhead 104 in an exemplary embodiment. The assumption for this embodiment is that printhead 104 is a flow-through head. In addition to piezoelectric actuator 210, chamber 212, and nozzle 214, jetting channel 202 includes a restrictor 1302 that controls a flow of print fluid from a supply manifold (e.g., manifold 310) to chamber 212. Jetting channel 202 also includes another restrictor 1304 that controls a flow of ink from chamber 212 to a return manifold (e.g., manifold 311). The use of two restrictors as in FIG. 13 allows for print fluid to circulate through jetting channel 202 even when no jetting occurs. The flow of the print fluid is illustrated by the arrows in FIG. 13. During circulation, the print fluid flows from a supply manifold, through restrictor 1302, and into chamber 212. The print fluid then flows through restrictor 1304 (instead of exiting out of nozzle 214), and enters the return manifold. As is evident from this figure, circulation of print fluid in jetting channel 202 is possible because restrictor 1304 allows print fluid to flow out of chamber 212 instead of sitting in chamber 212 and potentially drying or settling.

Although specific embodiments were described herein, the scope of the invention is not limited to those specific embodiments. The scope of the invention is defined by the following claims and any equivalents thereof.

What is claimed is:

1. An apparatus comprising:

a carriage assembly of a printer that reciprocates along scan directions, the carriage assembly comprising:

at least one printhead having a row of jetting channels for ejecting a print fluid; and reservoirs mounted on the carriage assembly that each supply the print fluid to the printhead;

wherein at least one of reservoirs is mounted on the carriage assembly to be offset from the row of jetting channels.

2. The apparatus of claim 1 wherein:

the at least one printhead includes manifolds disposed in the printhead along opposite sides of the row of jetting channels;

a first one of the manifolds is fluidly connected to a first one of the reservoirs, and fluidly connected to each of the jetting channels; and a second one of the manifolds is fluidly connected to a second one of the reservoirs, and fluidly connected to each of the jetting channels.

3. The apparatus of claim 2 wherein:

the first one of the manifolds is disposed in the printhead along a first side of the row of jetting channels, and parallels the row of jetting channels; and the second one of the manifolds is disposed in the printhead along a second side of the row of jetting channels, and parallels the row of jetting channels.

4. The apparatus of claim 1 wherein:

the row of jetting channels defines an axis perpendicular to the scan directions of the carriage assembly;

a first one of the reservoirs is offset from the axis by a first distance in a first scan direction; and a second one of the reservoirs is offset from the axis by a second distance in a second scan direction that is opposite the first scan direction.

5. The apparatus of claim 4 wherein:

the first distance and the second distance are equal.

6. The apparatus of claim 1 wherein:

the row of jetting channels defines an axis perpendicular to the scan directions of the carriage assembly;

a first one of the reservoirs is offset from the axis by a first distance in a scan direction;

a second one of the reservoirs is offset from the axis by a second distance in the scan direction; and the first distance is different than the second distance.

7. The apparatus of claim 1 wherein:

the at least one printhead comprises a flow-through printhead.

8. An apparatus comprising:

a carriage assembly of a printer that is configured to reciprocate along scan directions, the carriage assembly comprising:

a printhead having a row of jetting channels for ejecting a print fluid, a first manifold disposed along a first side of the row of jetting channels and fluidly connected to each of the jetting channels, and a second manifold disposed along a second side of the row of jetting channels and fluidly connected to each of the jetting channels;

a first reservoir fluidly connected to the first manifold of the printhead; and a second reservoir fluidly connected to the second manifold of the printhead;

wherein at least one of the first reservoir and the second reservoir is offset from the row of jetting channels.

9. The apparatus of claim 8 wherein:

the first reservoir is mounted on the carriage assembly on the first side of the row of jetting channels; and the second reservoir is mounted on the carriage assembly on the second side of the row of jetting channels.

10. The apparatus of claim 8 wherein:

the first reservoir and the second reservoir are mounted on the carriage assembly on the first side of the row of jetting channels.

11. The apparatus of claim 8 wherein:

the row of jetting channels defines an axis perpendicular to the scan directions of the carriage assembly;

the first reservoir is offset from the axis by a first distance in a first scan direction; and the second reservoir is offset from the axis by a second distance in a second scan direction that is opposite the first scan direction.

12. The apparatus of claim 11 wherein:

the first distance and the second distance are equal.

13. The apparatus of claim 8 wherein:

the row of jetting channels defines an axis perpendicular to the scan directions of the carriage assembly;

the first reservoir is offset from the axis by a first distance in a scan direction;

the second reservoir is offset from the axis by a second distance in the scan direction; and the first distance is different than the second distance.

14. The apparatus of claim 8 wherein:

the printhead comprises a flow-through printhead.

15. A printer comprising:

a carriage assembly comprising:

a conveyance structure that reciprocates along scan directions within the printer;

at least one printhead mounted on the conveyance structure, wherein the at least one printhead has a row of jetting channels for ejecting a print fluid, a first manifold disposed along a first side of the row of jetting channels and fluidly connected to each of the jetting channels, and a second manifold disposed along a second side of the row of jetting channels and fluidly connected to each of the jetting channels;

a first reservoir for storing the print fluid; and a second reservoir for storing the print fluid;

wherein at least one of the first reservoir and the second reservoir is mounted on the conveyance structure offset from the row of jetting channels.

16. The printer of claim 15 wherein:

the first reservoir is fluidly connected to the first manifold of the printhead; and the second reservoir is fluidly connected to the second manifold of the printhead.

17. The printer of claim 15 wherein:

the row of jetting channels defines an axis perpendicular to the scan directions of the conveyance structure;

the first reservoir is offset from the axis by a first distance in a first scan direction; and the second reservoir is offset from the axis by a second distance in a second scan direction that is opposite the first scan direction.

18. The printer of claim 17 wherein:

the first distance and the second distance are equal.

19. The printer of claim 15 wherein:

the row of jetting channels defines an axis perpendicular to the scan directions of the carriage assembly;

the first reservoir is offset from the axis by a first distance in a scan direction;

the second reservoir is offset from the axis by a second distance in the scan direction; and the first distance is different than the second distance.

20. The printer of claim 15 wherein:

the at least one printhead comprises a flow-through printhead.

* * * * *